United States Patent [19]

D'Hooge et al.

[11] 4,161,804

[45] Jul. 24, 1979

[54] HEAT-ACTUATED DOOR LATCH

[75] Inventors: Richard E. D'Hooge, Wood Dale; Frank S. Pasek, Westchester, both of Ill.

[73] Assignee: Rixson-Firemark, Inc., Franklin Park, Ill.

[21] Appl. No.: 862,723

[22] Filed: Dec. 21, 1977

[51] Int. Cl.[2] ..... E05F 15/20

[52] U.S. Cl. ..... 16/48.5; 49/7; 292/144; 292/164; 292/DIG. 66

[58] Field of Search ..... 16/48.5, 49, 137, 71, 16/DIG. 17; 49/1, 7, 8, 141, 31; 292/144, 164, DIG. 66, 92

[56] References Cited

U.S. PATENT DOCUMENTS

| | | | |
|---|---|---|---|
| 2,613,076 | 10/1952 | Bassett | 49/31 X |
| 3,284,840 | 11/1966 | Ulman | 16/48.5 |
| 3,415,562 | 12/1968 | Petersen | 16/48.5 X |
| 3,705,739 | 12/1972 | Adler | 16/48.5 X |
| 3,777,423 | 12/1973 | Coulter et al. | 16/48.5 X |
| 3,811,717 | 5/1974 | Floyd et al. | 16/48.5 X |
| 3,934,306 | 1/1976 | Farris | 16/48.5 |
| 4,007,954 | 2/1977 | Erickson | 49/7 X |
| 4,010,572 | 3/1977 | Peterson | 16/137 X |
| 4,034,437 | 7/1977 | Robertson et al. | 16/48.5 |
| 4,040,143 | 8/1977 | Lasier et al. | 16/48.5 |

FOREIGN PATENT DOCUMENTS

| | | | |
|---|---|---|---|
| 201912 | 5/1956 | Australia | 16/48.5 |

*Primary Examiner*—Werner H. Schroeder
*Assistant Examiner*—Moshe I. Cohen

[57] ABSTRACT

A door control comprising a heat-actuated door latch and a combination door-closing-arm holder and release. An optional smoke detector is located within a holder-release housing. During normal conditions, the door-closing arm is set at a hold-open angle free of the door to permit an easy door swing. In response to an emergency or smoke condition, the closing arm is released to pick up and close the door. In the event of excessive heat, the door is latched in response to the separation of fusible link segments. Heat from the side of the door opposite the latch housing is conducted through the door by a heat conducting rod.

6 Claims, 11 Drawing Figures

HEAT-ACTUATED DOOR LATCH

BACKGROUND OF THE INVENTION

This invention relates to a door control; and in particular to a heat-actuated door latch, which is used advantageously in combination with a door-closing-arm holder and release which effects free swinging of the door in non-emergency conditions and closes the door during an emergency.

In buildings housing elderly or infirm persons, life safety is of primary importance. These persons generally require the assistance of others in the event of an emergency since they have limited strength and mobility. Additionally, their response to emergency situations is slower than is that of normal persons, thus dictating a shorter time period for life saving measures. Accordingly, buildings designed primarily to house the elderly or infirm are required to meet more stringent life safety requirements than those designed for ordinary use.

One of the life safety requirements for such buildings may require the installation of automatic or alarm actuated door closers to confine smoke or flame.

In the usual installation, the door closer is of the automatic type, employing either a hydraulic or spring-loaded closing force. Such a closer exerts a force on a door at all times when it is opened. Thus, anyone at any time going through a door equipped with such a closer must overcome the closing force of the closer to pass through the doorway.

Door holder-closers, which are released in response to an emergency condition, all contain a similar undesirable feature. They are attached directly to the door and require the exertion of a manually applied force to open the door to overcome the closer under normal or non-emergency conditions.

The usual forces required to open a door, which is of no consequence to normal, healthy persons, are formidable obstacles to the elderly or infirm, and may be tiring or irritating to attendant staff members of a nursing home or hospital. The day to day inconvenience of pushing against door closers to both the residents and the attending staff has caused the removal of these devices in violation of the fire safety codes.

A second major objection to the use of automatic or alarm actuated door closers and door holder-closers relates to the relatively large installation and maintenance cost of these devices.

With respect to the high cost of using automatic door closing devices on room-to-corridor doors (patient room door), a cost reduction would be possible if existing latching hardware could be eliminated. Although room-to-corridor door requirements vary throughout the country, one consistent requirement is that doors must be latched closed in the event of fire. This is true whether automatic closing of doors is or is not required. Without latching, the pressure buildup during a fire may force a closed door open.

Latching of doors may be accomplished for patient room doors by the following devices: standard type latch sets, hospital type latch sets, and roller latches.

Standard latch sets are not often used because they require a free hand to unlatch the door. This can be a problem for attendants and occupants entering or exiting rooms.

Hospital latches overcome this problem with specially designed handles which permit unlatching to be accomplished with the elbow or forearm. These devices are substantially higher in cost than standard latch sets.

Roller latches need only push-pull hardware for opening and closing doors; however, they do not effect positive latching. The forces required to open and close doors vary from extremely high (over 10 lbs.) to no force at all, that is, little or no resistance to opening which may not keep the door closed under fire condition pressures.

All three of the above latching means have objectionable features. If the conventional latching devices could be eliminated and incorporated in an automatic closing device modified for a free door swing, for a slight cost, and perform only their function during a fire situation, it would eliminate the existing objections.

DESCRIPTION OF THE PRIOR ART

U.S. Pat. Nos. 4,010,572 and 4,034,437 disclose free-swing door closers.

SUMMARY OF THE INVENTION

Accordingly, the present invention comprises a door-closing-arm holder and release to which a spindle driven closing arm is attached. The arm has a roller at its outermost end which contacts a door-mounted guide. When an electromechanical holdercloser is energized and the door is pushed open, the door-mounted guide picks up the arm roller and rotates the closer spindle. The spindle continues turning during the door opening function until the spindle is placed in the hold-open mode. The arm, which is attached to the spindle, is maintained in that hold-open position as long as an electromagnet in the frame-mounted holder and release is energized.

The door, because it is not attached to the closing arm, is now allowed to swing free and be placed in any position desired from a totally closed position up to a maximum degree of opening permitted by the arm. The only resistance to opening, under normal conditions, would be the force required to overcome the friction created by the door hanging means and, perhaps, some resistance created by variable air pressure conditions. In either case, these resistant forces would be minimal, not exceeding about two pounds at the normal point of pulling or pushing a door.

In case of an alarm condition or power failure, the heldopen closing arm is released and permitted to swing closed. The arm roller picks up the door-mounted guide wherever the door is positioned at that moment, and brings the door to the closed position. The resistance to door opening is now increased because the spring of the closing mechanism must be overcome; however, that force should not exceed approximately eight pounds at the normal opening location.

The door swings closed whenever opened until power is restored to the electromagnet. The closing arm is then placed in the hold-open mode and the door is once again free swinging. This design feature eliminates the high resistance to opening during normal operation.

A heat-actuated latch, which has a retracted latch bolt, is associated with the closing device. The latch bolt is held in the retracted position by a fusible link. The link is disengaged at a specific temperature (135° or 165°) releasing the latch bolt into a strike plate similar to that employed with a standard-type latching device. Alternatively, the housing cover for the holder-release closure serves the function of the strike plate. Latching takes place only when a temperature rise at the door, caused by a fire, releases the bolt mechanism. At other times, the door never latches and only push-pull hardware is required to open the door.

The latch incorporates a heat conducting rod which passes through the door. In the event of a fire occurring on the side of the door opposite the fusible link, the rod readily conducts heat to the fusible link to effect timely disengagement of the latch bolt.

In order to ensure that the door is in the closed position to permit proper latching to occur, the automatic door closer is connected to a smoke detector or other type of device operable in response to an emergency, to release the door closing arm.

If, due to a malfunction of the latch, the door is inadvertently latched closed, means for unlatching the device is provided. Because of the location of the latch, the latch bolt is constructed so that a nominal force of fifty pounds against the door causes the bolt to break away, permitting access to the room or corridor. The fifty pound force would resist any known force created by a fire to prevent premature opening of the door under fire conditions.

BRIEF DESCRIPTION OF THE DRAWINGS

In order that all of the structural features for attaining the objects of this invention may be readily understood, reference is made in the detailed description of the invention to the drawings wherein.

DETAILED DESCRIPTION OF THE PREFERRED EMBODIMENT

Figure 1:
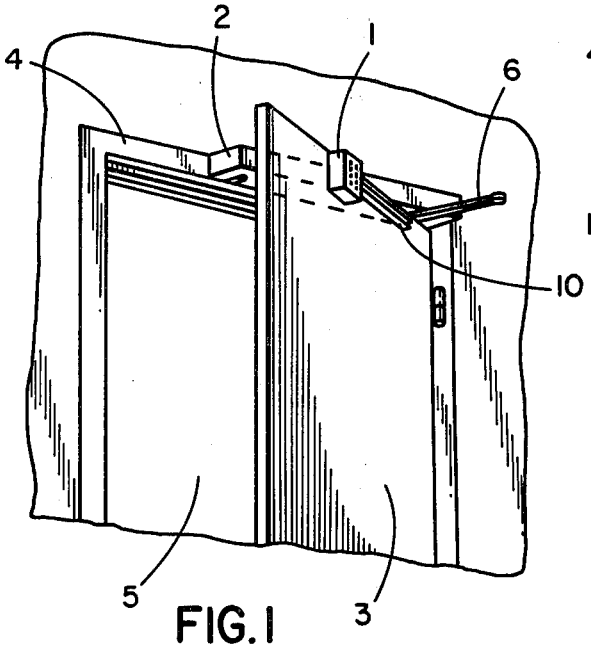
FIG. 1 is a perspective view of the heat-actuated door latch mounted on a normally free-swinging door which is controlled by a combination door-closing-arm holder and release incorporating a smoke detector.
Figure 2:
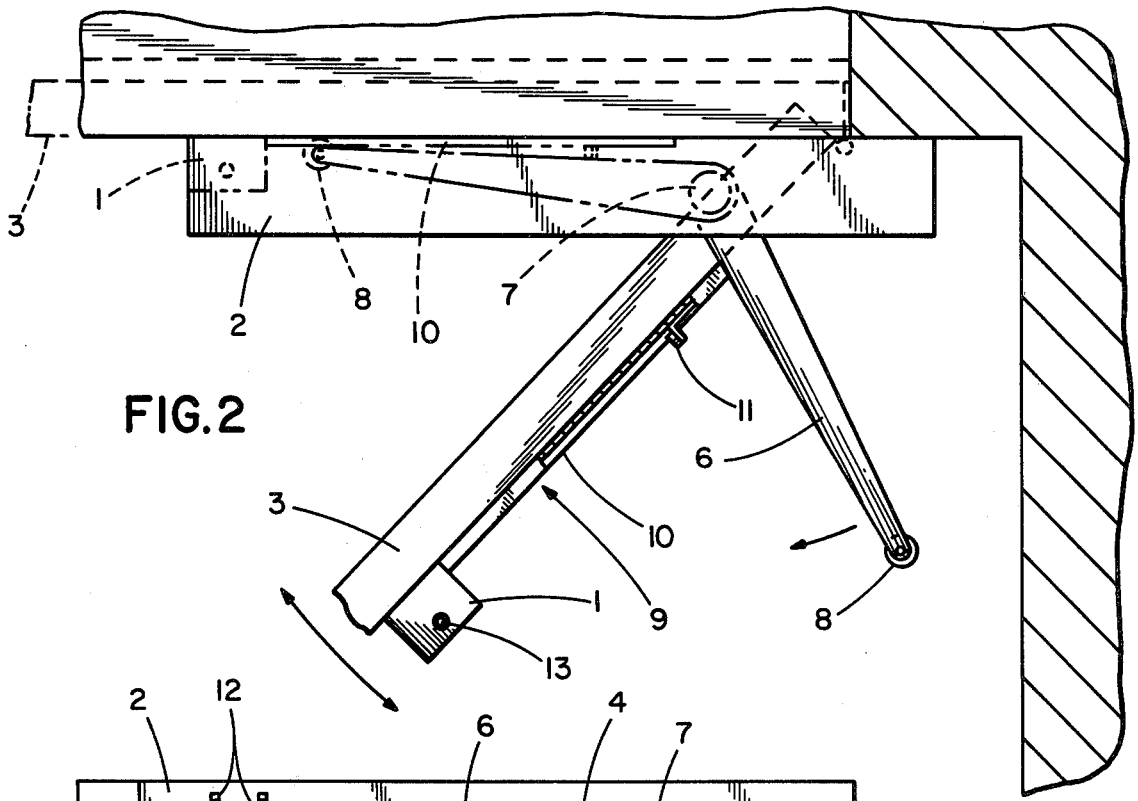
FIG. 2 is a plan view related to FIG. 1 which shows in solid line the door closing arm in a hold-open position with the door in an intermediate position, and in broken line the same arm in the door closed position.

Referring to FIGS. 1 and 2 of the drawings, the principal components of this invention comprise heat-actuated door latch 1 which is advantageously associated with combination door-closing-arm holder and release 2. The term "door-closing-arm holder and release", as used throughout this specification, refers to a modified door holder-closer typically shown in U.S. Pat. No. 3,777,423, issued Dec. 11, 1973 and U.S. Pat. No. 3,648,326, issued Mar. 14, 1972. The door controls of these patents are electromechanical devices; however, modified electrohydraulic or electropneumatic controls may also be used.

In the door holder-closers of the referenced patents, an electrically actuated device holds a controlled door at a prescribed door-open angle; and in response to an emergency condition or other signal the held door is released and is subjected to a closing force. These patented devices are modified, as is hereafter set forth in detail, in such a manner that a controlled door is not held open, but rather the door-closing arm is held at a prescribed door-open limit angle. In normal operation, the door is not under control of the closing arm; that is, the door may swing freely from a door-closed position to the limit defined by the closing arm.

In response to an emergency of alarm condition, the closing arm is released and picks up the door at whatever position it is in and applies a closing force to the otherwise freely positioned door.

Accordingly, a device which is a door-closing-arm holder and release in the sense of this specification, permits a free swing of the door during normal non-emergency conditions; whereas, under those same conditions a door under the control of a door holder-closer does not permit free swing, but rather a significant manual force must be applied to the control door to open or close the door. Under emergency or alarm conditions, the door is released when a door holder-closer is employed, but under the same conditions when a door-closing-arm holder and release is employed, the closing arm is released and this closing arm finds the door wherever it may be positioned and then closes the door.

With this background, door latch 1 is applied to the upper edge of free-swinging door 3; and door-closing-arm holder and release 2 is applied to the header frame portion of door frame 4 which defines door-opening 5.

In FIGS. 1 and 2, door-closing arm 6 (solid line) is shown in a hold-open position. So long as electrical power is applied to holder and release 2, door-closing arm 6 is maintained in the position shown in FIGS. 1 and 2 (solid line); however, in response to an emergency or an alarm condition, an electromagnet within holder and release 2 is deenergized enabling door-closing arm 6 to rotate in response to a driving force generated by spindle 7 (FIGS. 2 and 3) in a clockwise direction. Ultimately roller 8, located on the extremity of arm 6, picks up roller guide assembly 9 which is mounted on the upper edge of door 3.

Door 3 is then driven to the closed position by closing-arm 6. When door 3 is closed, roller 8 is positioned generally at the left portion of roller guide assembly 9 within guide channel 10. In the door-closed position, roller 8 is also positioned immediately adjacent heat-actuated door latch 1.

The right portion of guide channel 10 supports a rubber limit bumper 11. Bumper 11 defines the maximum door 3 opening angle permitted when roller 8 contacts the bumper 11. In FIGS. 1 and 2, for example, door 3 has been manually opened to locate door-closing arm 6 in a hold-open position. The maximum hold-open position of door-closing arm 6 is defined by the hold-open mechanism of holder and release 2. Door-closing arm 6 is retained in this hold-open position by the mechanism shown in the U.S. patents previously noted.

In the representations shown in FIGS. 1 through 4, the particular housing structure of U.S. Pat. No. 3,777,423 is shown inasmuch as the housing for holder and release 2 incorporates a smoke detector in the integral manner of U.S. Pat. No. 3,777,423. Smoke activates this detector by access through smoke access openings 12 located in the leftmost portion of the housing. The incorporation of an integral smoke detector within the housing for holder and release 2 is entirely optional. The smoke detector or other alarm actuating unit may be remotely located on a ceiling or wall location as is contemplated for use with U.S. Pat. No. 3,648,326.

In any event, the electromagnetic holding mechanism shown in both of the aforementioned patents is ideally suited for providing the spindle 7 drive for door-closing arm 6. The only modification necessary in the holder-closer and release structure of these patents is that relating to door-closing arm 6 and the use of a roller guide assembly 9 as shown in FIGS. 1 through 4.

The door-closing arm shown in the previously patented devices is fixed to the controlled door so that the door is not permitted a free swing.

In the present structure, the use of roller-carrying door-closing arm 6 and roller guide assembly 9 enables door 3 to drive door-closing arm 6 to a required hold-open position. In the event that the electromagnet of the patented devices is energized, the arm will be held open with the door permitted a free-swing between the closed position of FIGS. 3 and 4 and the limit position defined by roller 8 and limit bumper 11.

Figure 4:
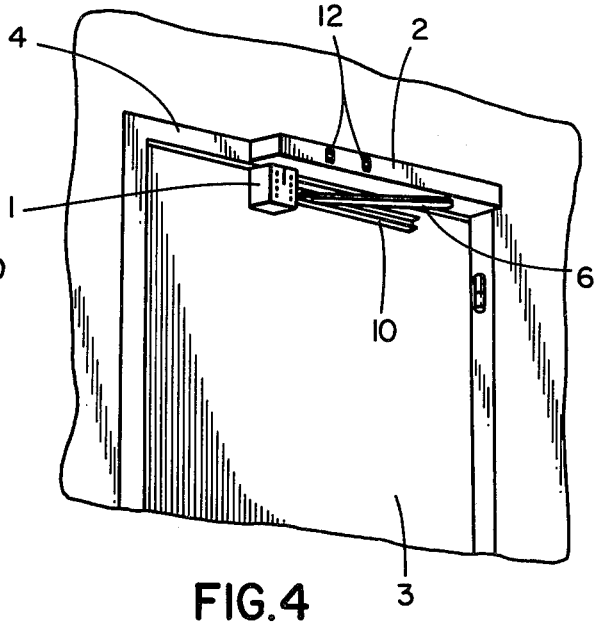
FIG. 4 is a perspective view of the structure of FIG. 3 to effect emergency closing of a free-swinging door.
Figure 3:
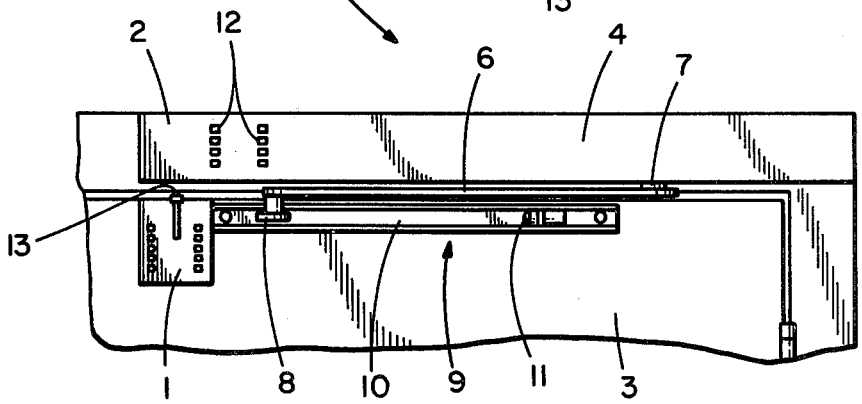
FIG. 3 is an elevation view related to FIGS. 1 and 2 which shows the disposition of components with the door closed in response to an emergency.

In the event the electromagnet is deenergized, door-closing arm 6 rotates in a clockwise direction and picks up door 3 and drives this door to the closed position shown in FIGS. 3 and 4.

Door 3, however, may be manually opened after the door is closed in response to an emergency condition; however, such opening will require a force to overcome this spring or other closing force generated by holder and release 2.

An emergency condition involving the generation of heat is accompanied by increase in room air pressure. The force generated by this increased pressure is often sufficiently large so that if directed in a door-opening direction it will overcome any spring or hydraulic closing force and open door 3. Thus, the necessary compartmentalization of a patient room and corridor to effect life safety cannot be attained unless the door is latched.

Accordingly, heat-actuated latch 1 is associated with holder and release 2 to effect a positive latch in response to the detection of excessive heat. Latch 1 is preferably located at the upper edge of door 3 adjacent roller assembly 9.

Figure 7:
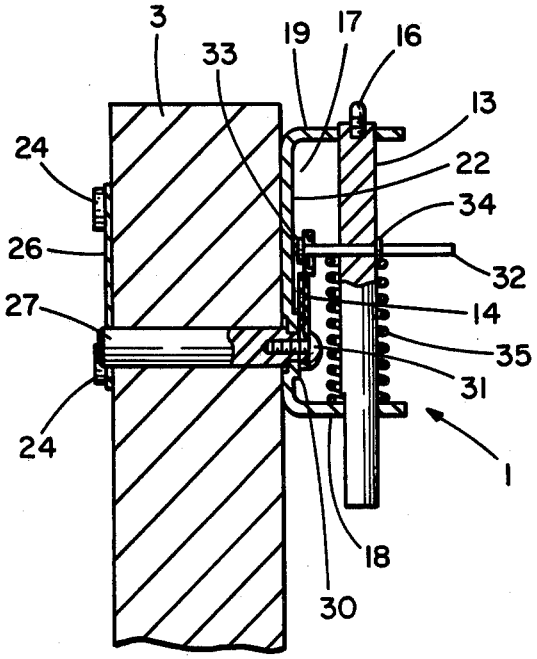
FIG. 7 is a section view of the door latch showing interior details of fusible link assembly and its association with the heat conducting rod.
Figure 8:
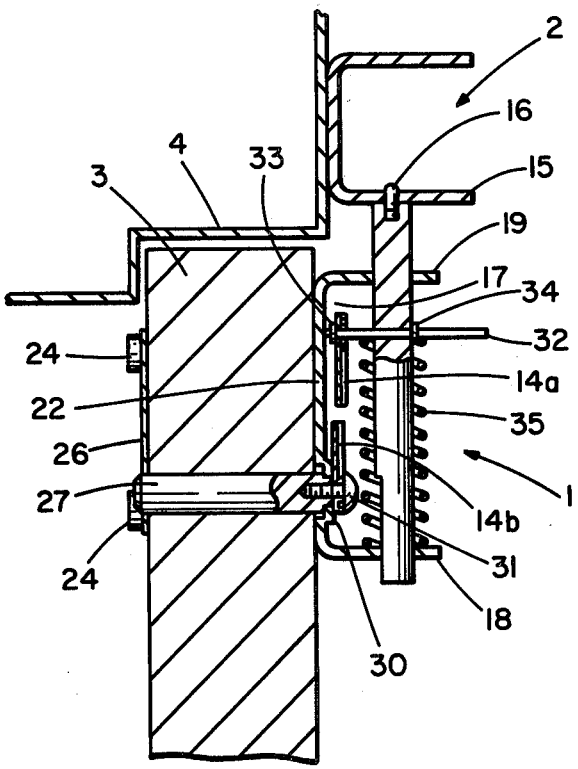
FIG. 8 is a section view which shows a latched door in response to a separated fusible link.
Figure 9:
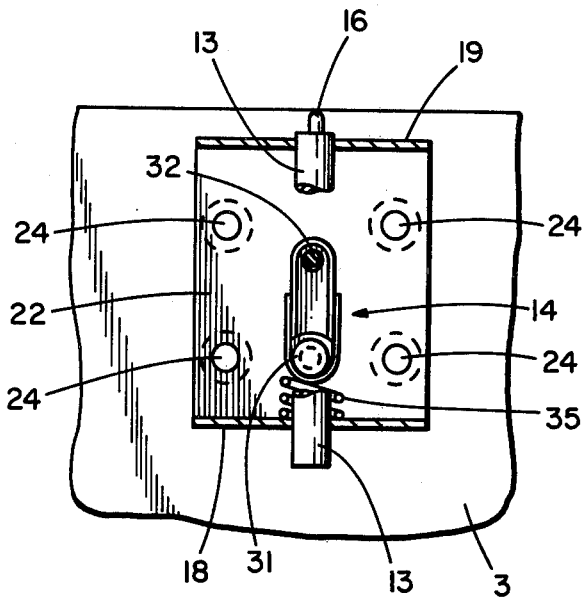
FIG. 9 is a view with some components broken away to show the mounting of the fusible link relative the heat conducting rod and the door bracket.
Figure 10:
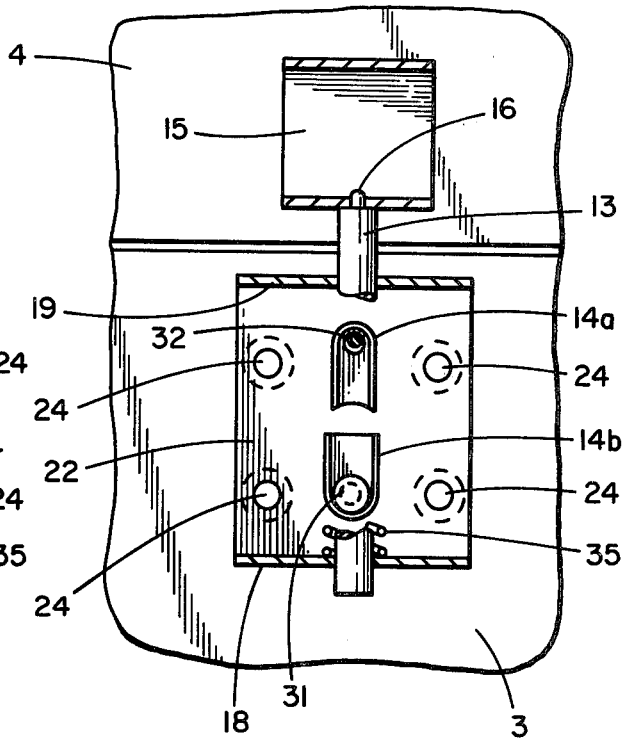
FIG. 10 is a view of the latch components effecting a door latch in response to the separation of the fusible link segments.
Figure 11:
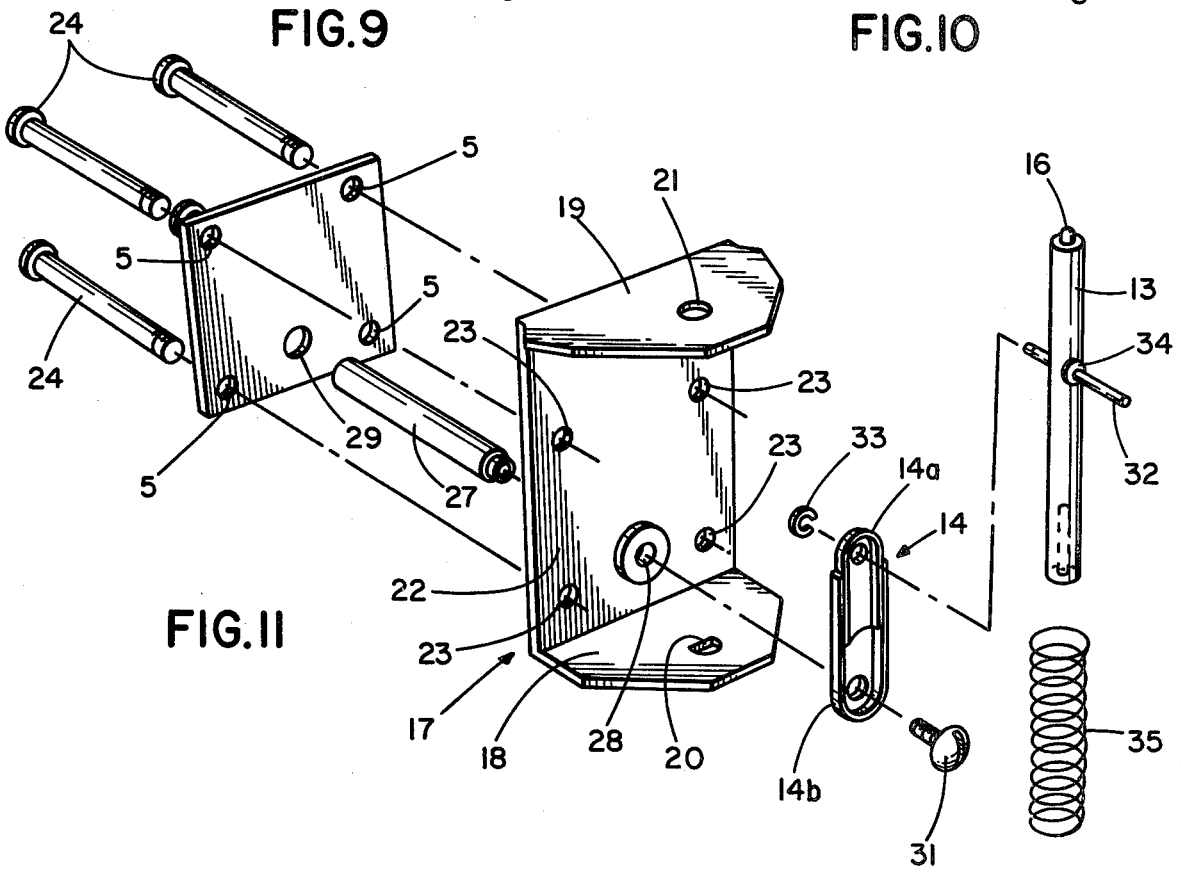
FIG. 11 is an exploded view of the fusible link assembly, heat conducting rod, door bracket, and latch mounting components.

Latch bolt 13 is normally held in the retracted position by a fusible link 14 (see FIGS. 7, 9 and 11). The fusible link segments 14*a* and 14*b* are separated at a specific temperature (typically either 135° or 165° F.), releasing latch bolt 13 into housing 15 for holder and release 2. The lower edge of housing 15 (FIG. 8) is apertured to receive latch shear pin 16. The engagement of latch pin 16 within housing 15 latches door 3 within its door opening as is shown in FIGS. 8 and 10. Pin 16 is designed so that a torque of approximately 200 foot pounds causes the pin to shear, thereby enabling door 3 to be manually opened when latched.

In the event that heat-actuated door latch 1 is not used in combination with a holder and release unit 2, the latch may engage a strike plate (not shown) similar to that employed with a standard-type latching device.

In the combination shown in the drawings inasmuch as the holder and release unit 2 is located at the door header, the latching function takes place at the top of door 3. If latch 1 is used alone, it may be mounted in any conventional latching location, not necessarily adjacent door header 4.

Latch bolt 13 is carried by U-shaped door mounting bracket 17. Door mounting bracket 17 is formed with a pair of bolt supporting flanges 18 and 19, each of which is formed with a hole 20, 21 within which the shank of latch bolt 13 may reciprocate as hereafter outlined.

Flanges 18 and 19 are integrally joined one to the other by bracket base plate 22. Bracket base plate 22 is formed with four holes 23. These holes 23 receive a set of four bolts 24 which pass through a set of holes 25 formed in back plate 26. The tightening of bolts 24 rigidly fixes door mounting bracket 17 in the required location on door 3 to effect a latch.

Metallic heat conducting rod 27 passes through door 3. The ends of heat conducting rod 27 are located in a hole 28 formed in bracket base plate 22 and a hole 29 formed in back plate 26. As is shown in FIG. 7, the left end of heat conducting rod 27 projects slightly beyond the exposed surface of back plate 26, and the right end of heat conducting rod 27 is housed within the circular shoulder 30 defining hole 28. The right end of heat conducting rod 27 is tapped so that retaining screw 31 engages and fixes the lower metallic segment 14*b* of fusible link 14 to this end of the heat conducting rod.

The upper segment 14*a* of fusible link 14 is mechanically retained relative latch bolt 13 by reset pin 32 which extends between fusible link segment 14*a* and passes through the shank of latch bolt 13 to extend beyond the bolt. A pair of retaining clips 33 and 34 fix reset pin with respect to fusible link 14 and latch bolt 13.

During normal non-emergency operation, latch bolt 13 is retained in the retracted position shown in FIGS. 7 and 9 inasmuch as fusible link 14 fixes reset pin relative heat conducting rod 27. Helical compression spring 35 envelopes the lower shank portion of latch bolt 13. The spring is disposed between supporting flange 18 and reset pin 32 so as to exert an upwardly lifting force on latch bolt 13 through reset pin 32. However, in the usual non-emergency condition, the fusible link 14 fixes reset pin in opposition to compression spring 35 so that the latch bolt cannot be released.

In the event of an emergency condition involving the generation of heat, heat is conducted to fusible link 14 from the left or far side of door 3 by heat conducting rod 27. Heat conducting rod 27 is preferably fabricated of a metal, such as aluminum, which readily conducts heat. Alternatively, heat generated from the right side of door 3, as viewed in FIG. 7, will ultimately also elevate the temperature of fusible link 14. In either event, after fusible link 14 has been subjected to sufficient heat, the link segments 14*a* and 14*b* separate, as is shown in FIGS. 8 and 10. This separation enables compression spring 35 to elevate latch bolt 13 to the latching positions also shown in FIGS. 8 and 10 so that latch shear pin 16 engages the strike provided by housing 15.

It should be understood that any heat which causes a release of the latch bolt has also previously caused door-closing arm 6 to pick up door 3 and close the door so that housing 15 of holder and release 2 is in a latching position. A continuation of the emergency condition involving heat releases latch 1 in accordance with the operation previously described. Should door 3 be latched and passage of patients or attendants is required through door opening 5, a manual exertion of about 200 foot pounds will shear pin 16 enabling the door 3 to disengage the latch by breaking the shear pin.

Figure 5:
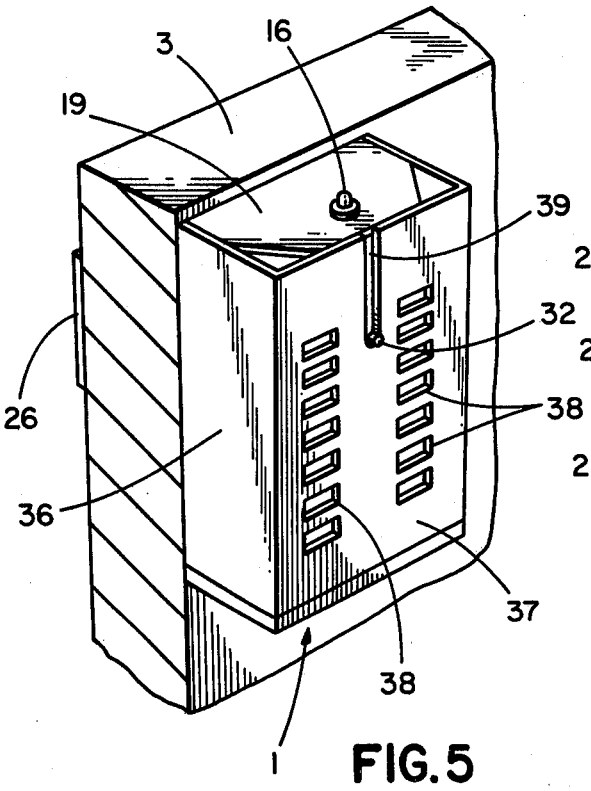
FIG. 5 is an enlarged perspective view showing exterior housing details of the door latch of FIG. 1.
Figure 6:
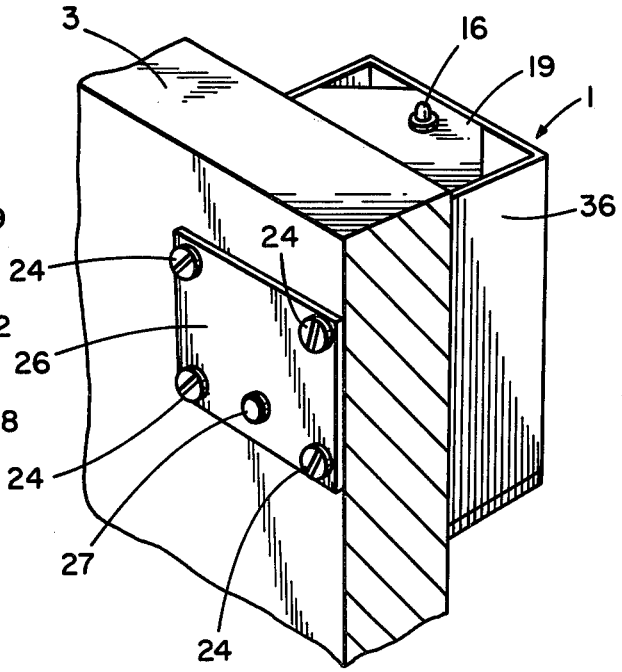
FIG. 6 is a rear perspective view of the door latch showing the door mounting arrangement including the heat conducting rod.

Latch cover 36 engages bracket 17 so that normally the mechanism of latch 1 is aesthetically covered. The front face 37 of cover 36 is preferably formed with a plurality of apertures 38 which enable heat to pass into the latch housing cavity so that fusible link 14 may be subjected to this heat at an early time. Apertures 38 are only effective to conduct heat from a source located on the right side of door 3, as viewed in FIG. 7. Cover face 37 is also formed with an elongated guide slot 39 through which the right end (FIGS. 5 and 7) of reset pin 32 projects. During the normal non-emergency conditions, the reset pin is housed at the lower portion of guide slot 39 and upon release caused by separation of fusible link segments 14*a* and 14*b*, as viewed in FIGS. 8 and 9, reset pin 32 is driven upwardly within guide slot 39.

After fusible link 14*a* and 14*b* has been separated, replacement of the fusible link is required because of the melting of the solder which normally retains segments 14*a* and 14*b* together. This replacement operation requires removal of screw 31 and the substitution of a fusible link which is intact and the fixing of this link by again tightening screw 31 and also engaging the upper end of the fusible link over reset pin 32 which has been lowered, as is shown in FIG. 7. With this replacement of the fusible link, latch cover 36 can again be placed upon heat-actuated door latch 1 so that the door will be in readiness for future latching if required.

It should be understood that the above-described arrangements are illustrative of the principles of this invention, and that modifications can be made without departing from the scope of the invention.

What is claimed is:

1. A heat-actuated door latch adapted for mounting on or near a door to latch the door closed, comprising; an integral fusible element separable when subjected to intense heat, a heat conducting element fixed to a first portion of the fusible element and shaped to extend completely through a door, latching means, supporting means carrying the latching means for latching movement, means coupling a second portion of the fusible element to the latching means to retain the latching means in an unlatched position, and latch force means exerting a latching force upon the latching means which releases the latching means to effect a latch in response to the separation of the fusible element.

2. The combination of claim 1 in which the fusible element is a fusible link having a pair of joined link segments which separate when subjected to intense heat, and in which a first segment is fixed to the heat conducting element and the second segment is connected to the coupling means.

3. The combination of claim 1 in which the heat conducting element is an elongaged metallic rod extending completely through a door.

4. The combination of claim 3 in which the latching means is an elongated bolt carried by the supporting means for reciprocating latching movement.

5. The combination of claim 4 in which the coupling means is an elongated reset pin projecting generally normally with respect to the longitudinal axis of the latch bolt, and in which the second segment of the fusible link is connected to the reset pin.

6. The combination of claim 5 in which the latch force means is a compression spring normally compressed to develop a force directed to separate the fusible link segments and which spring drives the latch bolt in a direction to effect a door latch when the fusible link segments are separated in response to intense heat.

* * * * *